US008517798B2

(12) United States Patent
Kimura et al.

(10) Patent No.: US 8,517,798 B2
(45) Date of Patent: Aug. 27, 2013

(54) POLISHING PAD, METHOD OF PRODUCING THE SAME AND METHOD OF PRODUCING SEMICONDUCTOR DEVICE BY USING THE SAME

(75) Inventors: Tsuyoshi Kimura, Osaka (JP); Yoshiyuki Nakai, Osaka (JP); Masahiro Watanabe, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 0 days.

(21) Appl. No.: 13/615,065

(22) Filed: Sep. 13, 2012

(65) Prior Publication Data

US 2013/0000459 A1 Jan. 3, 2013

Related U.S. Application Data

(62) Division of application No. 11/912,092, filed as application No. PCT/JP2006/303454 on Feb. 24, 2006, now abandoned.

(30) Foreign Application Priority Data

May 18, 2005 (JP) ..... 2005-145599

(51) Int. Cl.
*B24B 49/00* (2012.01)

(52) U.S. Cl.
USPC ..... 451/11; 451/54; 451/69; 29/557; 409/132; 409/145

(58) Field of Classification Search
USPC ..... 451/10, 11, 54, 69; 29/557; 409/132, 409/145
See application file for complete search history.

(56) References Cited

U.S. PATENT DOCUMENTS

| | | | | |
|---|---|---|---|---|
| 5,842,910 | A | 12/1998 | Krywanczyk et al. | |
| 6,120,366 | A | 9/2000 | Lin et al. | |
| 7,234,224 | B1 * | 6/2007 | Naugler et al. | 29/557 |
| 2004/0014413 | A1 | 1/2004 | Kawahashi et al. | |
| 2004/0266326 | A1 * | 12/2004 | Shiho et al. | 451/526 |
| 2005/0064709 | A1 * | 3/2005 | Shimomura et al. | 438/689 |
| 2005/0276967 | A1 * | 12/2005 | Prasad | 428/314.8 |

(Continued)

FOREIGN PATENT DOCUMENTS

| | | |
|---|---|---|
| EP | 0 878 270 | 11/1998 |
| JP | 61-79575 | 4/1986 |

(Continued)

OTHER PUBLICATIONS

Kimura et al., Office Action mailed Dec. 27, 2011 directed towards U.S. Appl. No. 11/912,092; (6 pages).

(Continued)

*Primary Examiner* — Eileen P. Morgan
(74) *Attorney, Agent, or Firm* — Morrison & Foerster LLP

(57) ABSTRACT

The present invention provides a polishing pad used for planarizing inter layer dielectrics and the like by CMP (chemical mechanical polishing) in the manufacturing process of a semiconductor device, a method of producing the polishing pad and a method of producing a semiconductor device by using the polishing pad. The present invention relates to a semiconductor wafer polishing pad having grooves in a polishing surface and formed from a foamed polyurethane, wherein a processed surface of the groove comprising a side surface and a bottom surface has a surface roughness Ra of not more than 10.

4 Claims, 4 Drawing Sheets

(56) References Cited

U.S. PATENT DOCUMENTS

| | | | | |
|---|---|---|---|---|
| 2008/0313967 | A1* | 12/2008 | Sakurai et al. | 51/298 |
| 2009/0104856 | A1* | 4/2009 | Hosaka et al. | 451/59 |
| 2009/0209185 | A1* | 8/2009 | Motonari et al. | 451/527 |

FOREIGN PATENT DOCUMENTS

| | | |
|---|---|---|
| JP | 2647046 | 8/1997 |
| JP | 10-249710 | 9/1998 |
| JP | 11-70463 | 3/1999 |
| JP | 2000-198061 | 7/2000 |
| JP | 2001-181649 | 7/2001 |
| JP | 2001-232555 | 8/2001 |
| JP | 2002-11630 | 1/2002 |
| JP | 2002-184730 | 6/2002 |
| JP | 2002-224950 | 8/2002 |
| JP | 2004-9156 | 1/2004 |
| JP | 2004-34176 | 2/2004 |
| JP | 2004-193390 | 7/2004 |
| JP | 2005-118996 | 5/2005 |

OTHER PUBLICATIONS

Kimura et al, Office Action mailed Jun. 22, 2012 directed towards U.S. Appl. No. 11/912,092; (6 pages).

International Search Report directed to counterpart International Application No. PCT/JP2006/303454 (4 pages).

International Preliminary Report on Patentability, mailed Mar. 27, 2008, directed to counterpart International Patent Application No. PCT/JP2006/303454. 5 pages.

* cited by examiner

POLISHING PAD, METHOD OF PRODUCING THE SAME AND METHOD OF PRODUCING SEMICONDUCTOR DEVICE BY USING THE SAME

REFERENCE TO RELATED APPLICATIONS

This application is a divisional of U.S. Ser. No. 11/912,092, filed May 1, 2008, which is a national stage application under 35 USC 371 of International Application No. PCT/JP2006/303454, filed Feb. 24, 2006, which claims priority from Japanese Patent Application No. 2005-145599, filed May 18, 2005, the entire contents of which are incorporated herein by reference.

FIELD OF THE INVENTION

The present invention relates to a polishing pad used for polishing a material to be polished, a method of producing the polishing pad and a method of producing a semiconductor device by using the polishing pad. More particularly, it relates to a polishing pad used for planarizing inter layer dielectrics and the like by CMP (chemical mechanical polishing) in the manufacturing process of a semiconductor device, a method of producing the polishing pad and a method of producing a semiconductor device by using the polishing pad.

BACKGROUND OF THE INVENTION

Recently, in semiconductor integrated circuits, the device size have been scale down and the integration has been improved, and micro processing has been required. In addition, the device structure has been complex and three-dimensional. The scale down has been accomplished by the improvement of micro processing technique in the manufacturing process of a semiconductor device, particularly high resolution in photolithography process which transfer a circuit pattern to photosensitive organic film (photo resist) coated on a silicon wafer. In the photolithography process, techniques of exposure by using a light source of shorter wavelength have been developed. A method of compensating the deficiency of the depth of focus to assure the resolution without defocus of a micro pattern by reducing unevenness in the device structure as possible has been attempted.

As a method of planarizing the unevenness in the device structure, the CMP method, to which mirror surface processing of a silicon wafer was applied, has been used. An apparatus for generally using in the CMP method is shown by reference to FIG. 1. The CMP apparatus used in the CMP method is provided with a polishing platen 2 for supporting a polishing pad 1 and with a supporting stand (polishing head) 5 for supporting a material to be polished 4 (such as a semiconductor wafer). The polishing platen 2 and the supporting stand 5 are arranged such that the polished pad 1 and the material to be polished 4, both of which are supported by them, are opposed to each other, and the polishing platen and the supporting stand are constituted to be capable of rotating around rotating shafts 6 and 7. The material to be polished 4 is stuck on the supporting stand 5 which is provided with a pressing mechanism for pushing the material to be polished 4 onto the polishing pad 1 at the time of polishing (not indicated). Abrasive (slurry) 3-feeding mechanism 8 is to feed an abrasive suspension having abrasive grains such as silica particles dispersed in an alkali solution to the polishing pad 1 on the polishing platen 2. In addition, the CMP apparatus comprises dresser having abrasive grains of diamond electrodeposited or melt bonded thereon to dress the surface of the polishing pad (not indicated).

As an example of the method, there is a method of dressing the polishing pad by dresser, rotating the shafts 6 and 7, pushing the wafer 4 onto the polishing pad 1 by the pressing mechanism while feeding an abrasive slurry from the abrasive slurry-feeding mechanism 8 to the center portion of the polishing pad to polishing the wafer. In the CMP method, micro scratches on the layer to be polished such as the inter layer dielectrics of the wafer, the dispersion of the abrasive rate and poor uniformity of the abrasive amount within the surface of a silicon wafer are problem.

In order to restrain the formation of the micro scratches, it is necessary that abrasive dust of the polishing pad and diamond of the dresser formed during dressing of the polishing pad, inter layer dielectrics, abrasive dust of the wafer and used abrasive slurry (collectively, abrasive waste) are discharged to the exterior of the polishing pad. In the conventional CMP apparatus, the abrasive waste is discharged by continuously feeding the abrasive slurry to the center portion of the polishing pad in a sufficient amount. In case of forming a dressed layer on the polishing pad by dressing and then polishing the wafer while feeding the abrasive slurry described above, the abrasive slurry is pushed out by centrifugal force from the rotation of the polishing pad and by pushing the wafer onto the polishing pad. Therefore, the abrasive slurry is almost discharged to the exterior of the polishing pad without concerning the polishing to consume excess abrasive slurry, which is expensive.

In order to dissolve the problems, various attempts have been made in the polishing method to improve the abrasive properties of the material to be polished. Among them, there have been various attempts with respect with grooves for remaining abrasive slurry on the polishing surface and discharging it.

In Japanese Patent No. 2647046, a polishing pad comprising grooves for flowing abrasive formed in the inner portion and the outer portion of the surface of the polishing pad, and a plurality of pores for retaining the abrasive formed on the surface of the polishing pad other than the portion that the grooves are formed, is disclosed. As one embodiment of the polishing pad, the polishing pad comprising lattice pattern groove formed in the center portion and the peripheral portion of the surface of the polishing pad, and pores formed in a portion between center portion and the peripheral portion, is described in FIG. 1. The pores are formed in broad area at once by using punches arranged in a line or a few lines. It is difficult to form the pores by using a processing apparatus generally used for that purpose. The technical effects of reducing the unusual retainment of the abrasive slurry based on the balance between feeding and discharging the abrasive slurry are not particularly disclosed. The term "unusual retainment" used herein means that the retainment of the abrasive slurry is in largely non-uniform state on the polishing surface of the polishing pad, which has a bad effect on polishing a material to be polished.

In Japanese Patent Kokai Publication No. 249710/1998, a polishing pad comprising grooves formed such that the groove shape geometrically having a center is eccentric to the polishing pad. It is described to dissolve a problem of transferring the groove shape to a silicon wafer processed to degrade the uniformity by the eccentricity of concentric circular groove to the polishing pad. However, it is difficult to prevent the abrasive rate in the center portion of the wafer from degrading. In addition, the technical effects of reducing of the unusual retainment of the abrasive slurry based on the balance between feeding and discharging the abrasive slurry are not particularly disclosed.

In Japanese Patent Kokai Publication No. 70463/1999, a polishing pad comprising a first zone having plural concentric circular grooves and a second zone having a second pitch. It is described that the polishing pad has two zones having a different groove pitch to improve the uniformity of the polishing. However, the technical effects of reducing of the unusual retainment of the abrasive slurry based on the balance between feeding and discharging the abrasive slurry are not particularly disclosed, and it is difficult to improve the uniformity of the polishing.

In Japanese Patent Kokai Publication No. 198061/2000, a polishing pad comprising plural loop grooves and plural stream-lined grooves is disclosed. In the polishing pad, it is attempted to positively control the flow of the abrasive slurry by forming the grooves into the stream-lined shape. However, in the polishing pad, it is problem that the abrasive slurry necessary to polishing flows out along the stream-lined grooves. In addition, the technical effects of reducing of the unusual retainment of the abrasive slurry based on the balance between feeding and discharging the abrasive slurry are not particularly disclosed, and the uniformity of the polishing is not sufficiently obtained.

In Japanese Patent Kokai Publication No. 224950/2002, a polishing pad comprising grooves having arc shaped bottom to prevent the abrasive slurry from stagnating. In the polishing pad, it is attempted to control the flow of the abrasive slurry smoothly by forming the grooves into the arc bottom shape. In the polishing pad, the shape of the groove and the surface roughness thereof are considered. However, it is different from the present invention in view that the polishing surface material is round graphite cast iron. In addition, it is different from the present invention in view that the material to be polished is bare wafer or glass substrate. Moreover, the unusual retainment of the abrasive slurry based on the balance between feeding and discharging the abrasive slurry are not discussed in case of using porous material as the polishing layer as described in the present invention.

In Japanese Patent Kokai Publication No. 9156/2004, a polishing pad comprising grooves, of which the inner surface has a surface roughness of not more than 20 μm, on the polishing surface. In the polishing pad, the surface roughness of the inner surface of the groove is considered. The surface roughness of the groove is obtained for the groove formed by cutting the polishing surface material or molding it in a mold. It has been found from an additional test by the present inventors that it is difficult for the inner surface of the groove to have the surface roughness of not more than 20 μm in case of forming the groove on the pore material by the above method. Therefore, a main object of the invention is the select of the polishing layer material rather than a method of forming grooves, which is different from the present invention. In addition, the unusual retainment of the abrasive slurry based on the balance between feeding and discharging the abrasive slurry are not discussed in case of using porous material as the polishing layer as described in the present invention.

In order to dissolve the problems, a polishing pad for processing semiconductor device that concentric circular grooves having right-angle edge are formed at the upper edge portion of the groove and groove processing tool are disclosed in Japanese Patent Kokai Publication Nos. 181649/2001 and 184730/2002, and a fine groove processing machine, processing tool and method of processing for forming concentric circular grooves or lattice pattern groove on semiconductor polishing pad for CMP processing are disclosed in Japanese Patent Kokai Publication No. 11630/2002.

In the polishing pad disclosed in Japanese Patent Kokai Publication. Nos. 181649/2001 and 184730/2002, it is easy to control the flow of the abrasive slurry between the device surface to be polished and the upper surface of the pad by forming concentric circular grooves having right-angle edges at the upper corner portion in cross section and adjusting the width, depth and pitch of the groove to specified ranges, and it is expected that hydroplaning is restrained and the soft metal surface of the device is effectively planarized by the CMP processing method. However, the cross section shape of the groove is not stable, and the flowability of the abrasive slurry varies every pad. Therefore, stable abrasive properties are not sufficiently obtained.

In the polishing pad comprising fine grooves formed by the groove processing tool disclosed in Japanese Patent Kokai Publication No. 11630/2002, the cross section shape of the groove is not stable, and the flowability of the abrasive slurry varies every pad. Therefore, scratches are easily formed, and stable abrasive properties are not sufficiently obtained.

In the above polishing pad disclosed in Japanese Patent Kokai Publications Nos. 181649/2001, 184730/2002 and 11630/2002, edges at the corner portion in cross section of the groove is right-angle by specifying the shape of the cutting edge of the groove processing tool, thereby it is attempted to restrain the occurrence of dulled edge and burr on the wall surface of the groove. Stable abrasive properties are not sufficiently obtained only by specifying the shape of the cutting edge of the groove processing tool.

SUMMARY OF THE INVENTION

A main object of the present invention is to dissolve problems at the same time, such as the occurrence of scratches, the non-uniformity or deterioration of the abrasive rate, the non-uniformity within wafer of the abrasive amount, the consumption of excess abrasive slurry and the suitable retainment of the abrasive slurry between the material to be polished and the polishing pad in a polishing pad used for planarizing inter layer dielectrics and the like by CMP (chemical mechanical polishing) in the manufacturing process of a semiconductor device, a method of producing the polishing pad and a method of producing a semiconductor device by using the polishing pad.

By dissolving the problems at the same time, the present invention provides a polishing pad used for planarizing inter layer dielectrics and the like by CMP (chemical mechanical polishing) in the manufacturing process of a semiconductor device, a method of producing the polishing pad and a method of producing a semiconductor device by using the polishing pad.

The polishing pad of the present invention is suitably used as a polishing pad used for planarizing a material to be polished by CMP (chemical mechanical polishing) in order to dissolve problems at the same time, such as the occurrence of scratches, the non-uniformity or deterioration of the abrasive rate, the non-uniformity within wafer of the abrasive amount, the consumption of excess abrasive slurry and the suitable retainment of the abrasive slurry between the material to be polished and the polishing pad. In order to dissolve the problems at the same time, the polishing pad of the present invention is a polishing pad comprising grooves on a polishing surface and formed from a foamed polyurethane, of which a processed surface of the groove comprising a side surface and a bottom surface has a surface roughness Ra of not more than 10.

The present invention relates to a semiconductor wafer polishing pad comprising grooves on a polishing surface and formed from a foamed polyurethane, wherein a processed surface of the groove comprising a side surface and a bottom surface has a surface roughness Ra of not more than 10.

In order to put the present invention into a more suitable practical application, it is preferable that the processed surface of the groove have a surface roughness Ra of 1 to 9.

In another embodiment, the present invention relates to a semiconductor wafer polishing pad comprising a polishing layer, wherein the polishing layer is formed from a porous material, a polishing surface of the polishing layer has grooves, and at least one portion of the inner surface of the groove has a non-porous surface.

In order to put the present invention into a more suitable practical application, it is preferable that:

- the non-porous surface have a center line average roughness Ra of a roughness curve of 1.0 to 5.0 μm;
- the groove have a depth of 0.5 to 1.5 mm;
- the polishing layer be formed from a porous material having an average cell diameter of 20 to 70 μm;
- the wherein the polishing layer have a specific gravity of 0.5 to 1.0 g/cm$^3$;
- the polishing layer have a compressibility of 0.5 to 5.0%;
- the polishing layer have a hardness of 45 to 65; and
- the polishing pad further comprise a cushion layer and the cushion layer have lower hardness than the polishing layer.

In further embodiment, the present invention relates to a method of producing a semiconductor wafer polishing pad comprising a step of mechanical cutting by stepwise varying a feed speed and feed amount of a groove processing tool to form concentric circular grooves having rectangle sectional shape on the polishing surface.

In order to put the present invention into a more suitable practical application, it is preferable that:

- the step of forming the grooves comprise stopping the feed of the groove processing tool for a certain time at the position that the groove processing tool reaches a desired depth;
- the feed speed and feed amount of a groove processing tool are stepwise varied and increased in order of precedence; and
- the polishing pad be formed from a foamed polyurethane.

In yet further embodiment, the present invention relates to a method of producing a semiconductor device comprising a step of polishing the surface of a semiconductor wafer by using the polishing pad of the present invention.

In the polishing of the semiconductor wafer and the like by using the polishing pad of the present invent, it is possible to dissolve problems at the same time, such as the non-uniformity or deterioration of the abrasive rate, the non-uniformity within wafer of the abrasive amount, the consumption of excess abrasive slurry and the suitable retainment of the abrasive slurry between the material to be polished and the polishing pad; and particularly it is effective to reduce the occurrence of scratches because the polishing pad has good balance between feeding and discharging the abrasive slurry during polishing to reduce the unusual retainment of the abrasive slurry in the grooves during polishing. Therefore, the polishing pad is effective to the manufacturing process of a semiconductor device, such as CMP of a semiconductor wafer.

BRIEF DESCRIPTION OF THE DRAWINGS

The present invention will become more fully understood from the detailed description given hereinbelow and the accompanying drawing which is given by way of illustration only, and thus are not limitative of the present invention, and wherein.

DETAILED DESCRIPTION OF THE INVENTION

Figure 3:
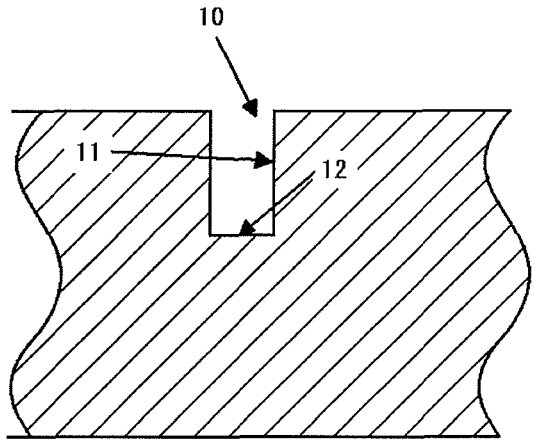
FIG. 3 is a schematic cross section illustrating one embodiment of the groove formed on the polishing layer of the polishing pad of the present invention.
Figure 4:
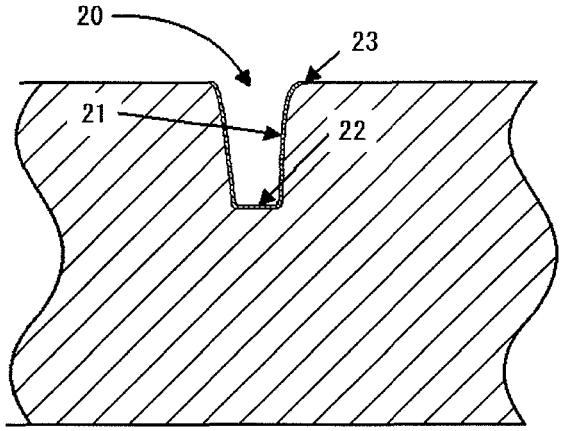
FIG. 4 is a schematic cross section illustrating the groove formed on the polishing layer of the conventional polishing pad.

The polishing pad of the present invention comprises grooves on a polishing surface and formed from a foamed polyurethane, wherein a processed surface of the groove comprising a side surface and a bottom surface has a surface roughness Ra of not more than 10. In another embodiment, the polishing pad of the present invention comprises a polishing layer, wherein the polishing layer is formed from a porous material, a polishing surface of the polishing layer has grooves, and at least one portion of the inner surface of the groove has a non-porous surface. In addition, the method of producing the polishing pad of the present invention comprises a step of mechanical cutting by stepwise varying a feed speed and feed amount of a groove processing tool to form concentric circular grooves having rectangle sectional shape on the polishing surface. The polishing pad of the present invention and the method of producing the same will be explained with reference to the accompanying drawing in detail. FIG. 3 is a schematic cross section illustrating one embodiment of the groove formed on the polishing layer of the polishing pad of the present invention. FIG. 4 is a schematic cross section illustrating the groove formed on the polishing layer of the conventional polishing pad. The drawings are schematic cross sections illustrating the groove formed on the polishing layer of the polishing pad, and the size is not exactly shown.

As shown in FIG. 3, in the polishing pad of the present invention, it is required for the processed surface of the groove comprising the side surface 11 and bottom surface 12 to have a surface roughness Ra of not more than 10, preferably 1 to 9, more preferably 1 to 5. When the surface roughness Ra is larger than 10, the flowability of the abrasive slurry is degraded, and cohesion thereof easily occurs or the clogging of abrasive waste easily occurs, which causes the formation of scratches.

It is desired that defects having a depth of not less than 100 μm (100 to 500 μm) or burrs having a length of 200 μm (200 to 1000 μm) are not more than 2 per one cross section in the groove in the polishing surface of the polishing pad of the present invention. When the number of the defects or burrs are larger than 2, the flowability of the abrasive slurry is degraded, and cohesion thereof easily occurs or the clogging of abrasive waste easily occurs, which causes the formation of scratches. The number of the defect and burr are measured by observing the groove cross section of a sample formed by dividing the polishing pad into five pieces in the radius direction to count the number of defects having the above depth and burrs having the above length.

Figure 5:
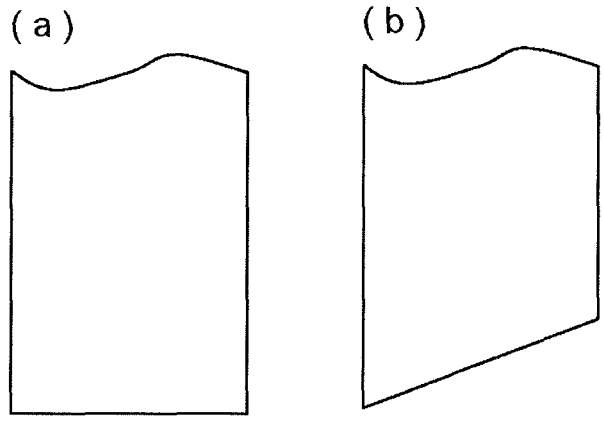
FIG. 5 is an enlarged schematic diagram illustrating one embodiment of the cutting edge of the groove processing tool used for the method of producing the polishing pad of the present invention [(a) front elevational view, (b) side elevational view].
Figure 6:
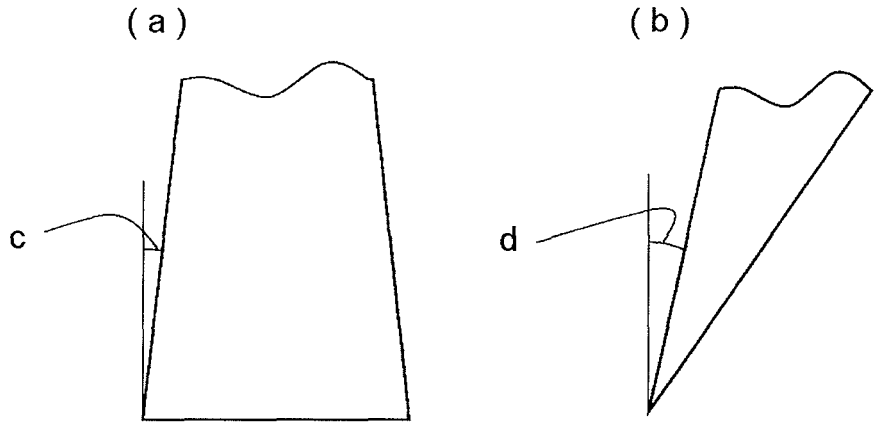
FIG. 6 is an enlarged schematic diagram illustrating the cutting edge of the groove processing tool used for the method of producing the conventional polishing pad [(a) front elevational view, (b) side elevational view].

FIG. 5 is an enlarged schematic diagram illustrating one embodiment of the cutting edge of the groove processing tool used for the method of producing the polishing pad of the present invention. FIG. 6 is an enlarged schematic diagram illustrating the cutting edge of the groove processing tool used for the method of producing the conventional polishing pad. As shown in FIG. 5, in the method of the polishing pad of the present invention, the grooves are formed by mechanical cutting with the groove processing tool and the concentric circular groove having rectangle sectional shape are formed on the polishing surface. It is desired that the sectional shape of the cutting edge of the groove processing tool used for the method of producing the polishing pad of the present invention be rectangle without the side relief angle c in the conventional groove processing tool shown in FIG. 6. When the groove processing tool having the side relief angle c is used, the width of the groove formed is small by the wear of the groove processing tool (FIG. 4), and the non-uniformity of the retaining amount of the abrasive slurry is not sufficiently obtained, which causes the non-uniformity and deterioration of the abrasive rate. In the side shape of the cutting edge of the groove processing tool, when the groove processing tool having the rake angle d in the conventional groove processing tool shown in FIG. 6 is used, the contact area of the groove processing tool with the polishing surface to be processed varies by the wear of the groove processing tool, and the desired surface roughness Ra of the groove processed surface is not sufficiently obtained (FIG. 4). Therefore, it is desired for the groove processing tool used for the method of producing the polishing pad of the present invention to have the cutting edge shape without the side relief angle c and the rake angle d as shown in FIG. 5.

In the method of producing the polishing pad of the present invention, it is required to mechanically cut while stepwise varying a feed speed and feed amount of a groove processing tool. The wording "stepwise varying" a feed speed and feed amount of a groove processing tool used herein refers to stepwise vary the feed speed and feed amount while forming one of concentric circular grooves. The value of the feed speed and the like at every step may be increased in order of precedence, decreased in order of precedence, or increased or decreased. The time at every step may be the same or different.

It is desired for the feed speed of a groove processing tool to be within the range of 0.01 to 0.10 m/min, preferably 0.01 to 0.08 m/min, more preferably 0.01 to 0.05 m/min and to be varied at 1 to 2 steps, preferably 2 to 3 steps, more preferably 2 to 5 steps while forming one of concentric circular grooves. When the feed speed is smaller than 0.01 m/min, the processing time is increased and the wear of the groove processing tool is accelerated. On the other hand, when the feed speed is larger than 0.10 m/min, the occurrence of the burr is increased, the load applied to the groove processing tool is increased and the groove shape is not stable.

When forming the groove at a constant low feed speed, the wear of the groove processing tool is large and the processing time is increased. Therefore, it is desired that the feed speed is increased in order of precedence. In addition, it is desired that there be a time of stopping the feed of the groove processing tool, that is, a time that the feed speed is zero at the position of reaching the groove processing tool to the deepest portion, that is, the desired groove depth. It is desired for the time of stopping the feed of the groove processing tool to be within the range of 0.5 to 5 seconds, preferably 1.0 to 3.0 seconds. When the time is longer than 5 seconds, the wear of the groove processing tool is large. On the other hand, when the time is shorter than 0.5 seconds, it is difficult to maintain the stable groove shape and surface state.

The feed amount of the groove processing tool is stepwise varied by stepwise varying the feed speed as described above. In addition, it is desired to stepwise vary the total feed amount of the groove processing tool, which varies depending on the desired groove depth, as the same as the feed speed.

As described above, in the method of producing the polishing pad of the present invention, the processed surface of the groove can have low surface roughness Ra of not more than 10 and the burr formed on the surface of the polishing pad by the groove processing is reduced to form concentric circular grooves having the desired rectangle sectional shape. When the roughness Ra of the processed surface of the groove is large, the flowability of the abrasive slurry and abrasive waste is degraded, which causes the formation of scratches as described above. As shown in FIG. 3, the burr formed on the surface of the polishing pad by groove processing is reduced to obtain grooves having right-angle edge at the upper edge portion of the groove using the method of producing the polishing pad of the present invention. In addition, the angle between the side surface 11 and bottom surface 12 is right-angle, and it is possible to stably form the grooves having precise rectangle sectional shape. Therefore, in the polishing pad obtained by the method of producing the polishing pad of the present invention, the shape of the groove formed on the polishing surface is stable, and the retaining amount of the abrasive slurry is stable. Therefore, the problems, such as the non-uniformity or deterioration of the abrasive rate, the non-uniformity within wafer of the abrasive amount and the consumption of excess abrasive slurry, are dissolved. In addition, the suitable retainment of the abrasive slurry between the material to be polished and the polishing pad can be obtained.

In the polishing pad of the present invention, the width, depth and pitch of the groove are not limited as long as the grooves having precise rectangle sectional shape are stably formed, but the groove may have a width of 0.2 to 5.0 mm, a depth of 0.2 to 4.0 mm and a pitch of 0.5 to 6.0 mm, which may be suitably selected from the ranges depending on the material to be polished, the method of polishing and polishing condition. In the present invention, the concentric circular grooves preferably have the same width, the same depth and the same pitch, respectively. In case of using such polishing pad, it is easy to control the abrasive rate, and it is convenient during producing the polishing pad.

The polishing pad of the present invention may be a single-layered polishing pad, which has been conventionally used, or a laminated polishing pad comprising at least two layers of polishing layer (hard surface layer) contact with the material to be polished, such as a semiconductor wafer and an cushion layer (elastic supporting layer) positioned between the polishing layer and a polishing platen, or a multi-layered polishing pad.

In the laminated polishing pad, the polishing layer and cushion layer are separately formed. It is desired for the polishing layer to have a hardness of 45 to 65. When the hardness of the polishing layer is lower than 45, the planarity of the material to be polished is degraded. On the other hand, when the hardness of the polishing layer is higher than 65, the planarity is good, but the uniformity of the material to be polished is degraded. The hardness of the polishing layer was measured according to JIS K6253-1997. The material for the polishing layer was cut into a size of 2 cm×2 cm (a proper thickness) as a sample for measuring the hardness, and the sample was left at a temperature of 23° C.±2° C. and humidity of 50%±5% for 16 hours. The hardness of the polishing layer was measured by using a stack of the samples having a thickness of not less than 6 mm with a hardness meter (Asker D hardness meter manufactured by Kobunshi Keiki Co., Ltd.). It is desired for the cushion layer to have a hardness of 25 to 100, preferably 30 to 85. The hardness of the cushion layer was measured with a hardness meter (Asker A hardness meter manufactured by Kobunshi Keiki Co., Ltd.) according to JIS K6253-1997. It is desired for the polishing layer to have a thickness of 0.2 to 4.0 mm, preferably 0.8 to 3.0 mm. It is desired for the cushion layer to have a thickness of 0.5 to 2.5 mm, preferably 1.0 to 2.0 mm.

In the single-layered polishing pad, the thickness is 1.0 to 5.0 mm and the material thereof may be suitably selected and used from the material used for the polishing layer and cushion layer.

In the laminated polishing pad, a material for the polishing layer is not limited as long as it satisfies the above hardness range, but the polishing layer is preferably formed from porous material. Examples of the porous materials include, for example, polyurethane resin, polyester resin, polyamide resin, acrylic resin, polycarbonate resin, halogen-based resin (such as polyvinyl chloride, polytetrafluoroethylene, and polyvinylidene fluoride), epoxy resin, photosensitive resin and the like. The porous material may be used alone, but the porous material may be used in combination with at least one of the other porous material.

In the present invention, particularly preferred is foamed polyurethane resin as the material for the polishing layer, because the polyurethane resin has excellent wear resistance and polymer having a desired physical properties can be easily obtained by varying a composition of raw material.

A method of foaming the polyurethane resin is not limited, but includes chemical foaming method using a foaming agent, mechanical foaming method, a method of adding hollow micro beads or precursor forming hollow micro beads by heating, or combinations thereof. Micro foam used for the polishing pad of the present invention is formed by the foaming method.

The polyurethane resin comprises isocyanate-terminated urethane prepolymer and chain extender. The isocyanate-terminated urethane prepolymer comprises polyisocyanate, low molecular weight polyol and high molecular weight polyol.

Examples of the polyisocyanates, which are not limited, include 2,4- and/or 2,6-diisocyanato toluene, 2,2'-, 2,4'- and/or 4,4'-diisocyanato diphenylmethane, 1,5-naphthalene diisocyanate, p- and m-phenylene diisocyanate, dimeryl diisocyanate, xylylene diisocyanate, diphenyl-4,4'-diisocyanate, 1,3- and 1,4-tetramethylxylydene diisocyanate, tetramethylene diisocyanate, 1,6-hexamethylene diisocyanate, dodecamethylene diisocyanate, cyclohexane-1,3- and 1,4-diisocyanate, 1-isocyanato-3-isocyanatomethyl-3,5,5-trimethylcyclohexane (=isophorone diisocyanate), bis-(4-isocyanatocyclohexyl)methane (=hydrogenated MDI), 2- and 4-isocyanatocyclohexyl-2'-isocyanatocyclohexylmethane, 1,3- and 1,4-bis-(isocyanatomethyl)-cyclohexane, bis-(4-isocyanato-3-methylcyclohexyl)methane and the like. These may be used alone or in combination of two or more thereof. The polyisocyanate may be suitably selected depending on the desired pot-life during casting and molding.

Examples of the high molecular weight polyols include hydroxy-terminated polyester, polycarbonate, polyester carbonate, polyether, polyether carbonate, polyesteramide and the like. Preferred are polyether and polycarbonate in view of good hydrolysis resistance, and preferred is polyether in view of cost and melt viscosity. Examples of the polyether polyols include reaction products of starting compound having a reactive hydrogen atom with alkylene oxide, such as ethylene oxide, propylene oxide, butylene oxide, styrene oxide, tetrahydrofuran, epichlorohydrin, or mixtures of these alkylene oxides. Examples of the starting compounds having a reactive hydrogen atom include water, bisphenol and divalent alcohol for preparing polyester polyol described later.

Examples of polycarbonates having a hydroxy group include reaction products of diols, such as 1,3-propanediol, 1,4-butanediol, 1,6-hexanediol, diethylene glycol, polyethylene glycol, polypropylene glycol and/or polytetramethylene glycol, with phosgene, diallyl carbonate (such as diphenyl carbonate) or cyclic carbonate (propylene carbonate). Examples of polyester polyols include reaction products of divalent alcohol with dibasic dicarboxylic acid, but it is desired to have larger distance between ester bonds in order to improve hydrolysis resistance. It is preferable that both the divalent alcohol and dibasic dicarboxylic acid have longer chain component.

Examples of divalent alcohols, which are not limited, include ethylene glycol, 1,3- and 1,2-propylene glycol, 1,4- and 1,3- and 2,3-butylene glycol, 1,6-hexane glycol, 1,8-octane glycol, neopentyl glycol, cyclohexanedimethanol, 1,4-bis-(hydroxymethyl)-cyclohexane, 2-methyl-1,3-propanediol, 3-methyl-1,5-pentanediol, 2,2,4-trimethyl-1,3-pentanediol, diethylene glycol, dipropylene glycol, triethylene glycol, tripropylene glycol, dibutylene glycol and the like.

Examples of the dibasic dicarboxylic acids include aliphatic, cycloaliphatic, aromatic and/or heterocyclic dibasic dicarboxylic acid, but preferred is aliphatic or cycloaliphatic dibasic dicarboxylic acid because it is required that the resulting NCO terminated prepolymer is liquid or low melt viscosity. If aromatic dibasic dicarboxylic acid is applied, it is preferable to use in combination with aliphatic or cycloaliphatic dibasic dicarboxylic acid. Examples of the dicarboxylic acids, which are not limited, include succinic acid, adipic acid, suberic acid, azelaic acid, sebacic acid, phthalic acid, isophthalic acid, terephthalic acid, naphthalene dicarboxylic acid, cyclohexane dicarboxylic acid (o-, m-, p-), dimeric fatty acid (such as oleic acid) and the like. The polyester polyol may have a portion of carboxyl terminated group. Lactones, such as ∈-caprolactone, or polyester of hydroxycarboxylic acid, such as ∈-hydroxycapronic acid may be also used.

Number average molecular weight of the high molecular weight polyol is not limited, but is preferably within the range of 500 to 2,000 in view of the elastic properties of the resulting polyurethane. When the number average molecular weight is lower than 500, the elastic properties of the resulting polyurethane resin is not sufficiently obtained, which is brittle resin. Therefore, the polishing layer prepared from the polyurethane resin is hard and brittle, which causes the formation of scratches on the polishing surface of the material to be polished. The polishing pad from the polyurethane resin is easily worn, and it is not suitable in view of life of the polishing pad. On the other hand, when the number average molecular weight is higher than 2,000, the resulting polyurethane resin is soft, and the polishing layer prepared from the polyurethane resin tends to have poor planarity.

Examples of low molecular weight polyols include divalent alcohols for preparing polyester polyol described above. As the low molecular weight polyols used for the present invention, it is preferable to use at least one selected from the group consisting of diethylene glycol, 1,3-butylene glycol, 3-methyl-1,5-pentanediol and 1,6-hexamethylene glycol, or mixtures thereof. If ethylene glycol or 1,4-butylene glycol as low molecular weight polyols other than those used for the present invention is used, the reactivity is too high during casting and molding, or the hardness of the resulting polyurethane molded polishing material is too high, and the polishing material of the present invention is brittle or the surface of IC is easy to damage. On the other hand, if divalent alcohols having longer chain than 1,6-hexamethylene glycol are used, suitable reactivity during casting and molding, or suitable hardness of the resulting polyurethane molded polishing material is sometimes obtained. However, the cost is too high, and it is not useful to use the divalent alcohols.

Since it is necessary to select the isocyanate component depending on the desired pot-life during casting and molding and to lower the melt viscosity of the resulting NCO terminated prepolymer, the isocyanate component is applied alone or in combination with two or more. Examples thereof, which are not limited, include 2,4- and/or 2,6-diisocyanato toluene, 2,2'-, 2,4'- and/or 4,4'-diisocyanato diphenylmethane, 1,5-naphthalene diisocyanate, p- and m-phenylene diisocyanate, dimeryl diisocyanate, xylylene diisocyanate, diphenyl-4,4'-diisocyanate, 1,3- and 1,4-tetramethylxylydene diisocyanate, tetramethylene diisocyanate, 1,6-hexamethylene diisocyanate, dodecamethylene diisocyanate, cyclohexane-1,3- and 1,4-diisocyanate, 1-isocyanato-3-isocyanatomethyl-3,5,5-trimethylcyclohexane (=isophorone diisocyanate), bis-(4-isocyanatocyclohexyl)methane (=hydrogenated MDI), 2- and 4-isocyanatocyclohexyl-2'-isocyanatocyclohexylmethane, 1,3- and 1,4-bis-(isocyanatomethyl)-cyclohexane, bis-(4-isocyanato-3-methylcyclohexyl)methane and the like.

A ratio of the high molecular weight polyol to the low molecular weight polyol is determined depending on the performance requirement of the polishing layer prepared by using these polyols.

Examples of the chain extenders used for the present invention include, for example, organic diamine compounds. Examples of the organic diamine compounds, which are not limited, include 4,4'-methylene-bis(o-chloroaniline), 2,6-dichloro-p-phenylenediamine, 4,4'-methylene-bis(2,3-dichloroaniline), 3,3'-dichloro-4,4'-diaminodiphenylmethane, chloroaniline-modified dichlorodiaminodiphenylmethane, 1,2-bis(2-aminophenylthio)ethane, trimethylene glycol-di-p-aminobenzoate, 3,5-bis(methylthio)-2,6-toluene diamine and the like. The low molecular weight polyols described above can be used as the chain extenders. They may be used alone or in combination with two or more.

The ratio of the organic isocyanate, polyol and chain extender during preparing polyurethane resin can suitably change depending on molecular weight of each component and the desired properties of the polishing layer formed therefrom. In order to obtain the polishing layer having excellent abrasive properties, it is desired that a ratio of number of isocyanate group in the organic isocyanate to the total number of functional groups (hydroxyl group and amino group) in the polyol and chain extender be within the range of 0.95 to 1.15, preferably 0.99 to 1.10.

The polyurethane resin of the present invention can be produced by known urethane-making techniques. The polyurethane resin may optionally contain stabilizers such as antioxidants, surfactants, lubricants, pigments, fillers, antistatic agents, and the other additives.

In the polishing pad of the present invention, it is desired for the foamed polyurethane for the polishing layer (that is, the porous material for the polishing layer or micro fine foam for the polishing zone) to have an average cell diameter of not more than 70 μm, preferably 20 to 70 μm, more preferably 30 to 50 μm. When the average cell diameter is out of the range, the planarity is not sufficiently obtained. The planarity means smoothness in micro structure of the material to be polished, such as a semiconductor wafer. As a method of measuring the average cell diameter in the foamed polyurethane, for example, there is a method of measuring the diameter of the cells at a specified area by using an image processing unit.

In the polishing pad of the present invention, it is desired for the foamed polyurethane for the polishing layer to have a specific gravity of 0.5 to 1.0 g/cm$^3$. When the specific gravity is lower than 0.5 g/cm$^3$, the strength of the surface of the polishing layer (polishing zone) is reduced, and the planarity of the material to be polished, such as a semiconductor wafer is degraded. On the other hand, when the specific gravity is higher than 1.0 g/cm$^3$, the number of the micro pore in the polishing layer (polishing zone) is reduced, and the planarity is good, but the abrasive rate tends to be degraded. The specific gravity is a ratio of a mass of a sample to a mass of pure water having the same volume as the sample at a pressure of 1.01 bars and a temperature of 4° C. The specific gravity can be measured according to JIS 28807.

In the polishing pad of the present invention, it is desired for the foamed polyurethane for the polishing layer (polishing zone) to have a hardness of 45 to 65, preferably 40 to 60. When the hardness is lower than 45, the planarity of the material to be polished is degraded. On the other hand, when the hardness is higher than 65, the planarity is good, but the uniformity within wafer tends to be degraded. The uniformity means the uniformity of abrasive amount within the surface of a silicon wafer.

In the polishing pad of the present invention, it is desired for the foamed polyurethane for the polishing layer (polishing zone) to have a compressibility of 0.5 to 5.0%, preferably 0.5 to 3.0%. When the compressibility is within the above range, both the planarity and uniformity can be sufficiently obtained. The compressibility is determined by using the following formula:

$$\text{Compressibility (\%)}=[(T_1-T_2)/T_1]\times 100$$

wherein $T_1$ represents the thickness of a sample after application of 30 kPa (300 g/cm$^2$) stress for 60 seconds to the sample, and $T_2$ represents the thickness of the sample after application of 180 kPa (1,800 g/cm$^2$) stress for 60 seconds to the sample in the state $T_1$.

In the polishing pad of the present invention, it is desired for the foamed polyurethane for the polishing layer (polishing zone) to have a compressibility recovery of 50 to 100%. When the compressibility recovery is out of the above range, the thickness of the polishing layer is largely changed by repeated loading from the material to be polished, and the stability of the abrasive properties is degraded.

In the polishing pad of the present invention, it is desired for the foamed polyurethane for the polishing layer (polishing zone) to have a storage elastic modulus of not less than 200 MPa as measured by dynamic viscoelastic measurement at a temperature of 40° C. and a frequency of 1 Hz. When the storage elastic modulus is less than 200 MPa, the strength of the surface of the polishing layer is reduced, and the planarity of the material to be polished, such as a semiconductor wafer is degraded. The storage elastic modulus means elastic modulus measured by applying sine wave vibration to the foam polyurethane as a sample with a tensile mode folder of a dynamic viscoelasticity spectrometer.

The method of preparing closed-cell type foamed polyurethane suitably used in the polishing layer for the polishing pad of the present invention will be explained in detail hereinafter. The method of preparing the foamed polyurethane comprises the following steps (a) to (c).

(a) Stirring to Prepare a Cell Dispersion of an Isocyanate-Terminated Prepolymer;

A silicone-based surfactant is added to an isocyanate-terminated prepolymer and stirred in an inert gas, and the inert gas is dispersed as fine cells to form a cell dispersion. When the isocyanate-terminated prepolymer is in a solid form at ordinary temperatures, the prepolymer is melted by pre-heating to a suitable temperature.

(b) Mixing a Curing Agent (Chain Extender);

A chain extender is added to, and mixed with, the cell dispersion under stirring.

(c) Curing Step

The isocyanate-terminated prepolymer mixed with the chain extender is cast in a mold, and heat-cured.

The inert gas used in production of the polyurethane resin foam is used for forming fine cells, and it is preferably not combustible. Examples of the gases include nitrogen, oxygen, a carbon dioxide gas, a rare gas such as helium and argon, and a mixed gas thereof, and the air dried to remove water is most preferable in view of cost.

As a stirrer for dispersing the inert gas in the silicone-based surfactant-containing isocyanate-terminated prepolymer to form fine cells, well known stirrers can be used without particular limitation, and examples thereof include a homogenizer, a dissolver, a twin-screw planetary mixer and the like. The shape of an agitator of the stirrer is not particularly limited either, but a whipper-type agitator is preferably used to form fine cells.

In a preferable embodiment, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the agitator are preferably adjusted as necessary.

In the method of preparing the foamed polyurethane, heating and post-curing of the foam obtained by casting the cell dispersion in a mold and reacting it until the dispersion lost fluidity are effective in improving the physical properties of the foam, and are extremely suitable. The cell dispersion may be cast in a mold and immediately post-cured in a heating oven, and even under such conditions, heat is not immediately conducted to the reactive components, and thus the diameters of cells are not increased. The curing reaction is preferably conducted at normal pressures to stabilize the shape of cells.

In the preparation of the polyurethane resin, a well known catalyst accelerating polyurethane reaction, such as tertiary amine-based catalysts, organotin-based catalysts, may be used. The type and amount of the catalyst added are determined depending on flow time in casting in a predetermined shape mold after the mixing step.

The production of the foamed polyurethane may be in a batch system where each component is weighed and introduced into a vessel, or in a continuous production system where each component and an inert gas are continuously supplied to and stirred in a stirring device and the resulting cell dispersion is provided to produce molded articles.

The polishing layer used for the polishing pad of the present invention can be produced by cutting a sheet of the foamed polyurethane resin prepared as described above into a predetermined size.

In the polishing pad of the present invention, it is desired for the polishing layer to have a thickness, which is not limited, of 0.6 to 3.5 mm. Examples of the methods of preparing the polishing layer having the above thickness include a method of processing the foam block produced by the method described above to a given thickness by a slicer of band saw type or planer type; a method of casting resin in a mold comprising a cavity having a given thickness to cure it; a method of using coating technique or sheet molding technique; and the like.

It is desired for the polishing layer to have a variability of thickness of not more than 100 μm, preferably not more than 50 μm. When the variability of thickness is larger than 100 μm, the polishing layer has large crinkle, and portions having different contact state with the material to be polished are formed, which degrades the abrasive performance. In order to dissolve the variability of thickness of the polishing layer, the surface of the polishing layer is dressed by dresser having abrasive grains of diamond electrodeposited or melt bonded thereon at initial stage of polishing. However, when the variability of thickness is larger than the upper limit, dressing time is long, which reduces the productive efficiency.

In addition, in order to restrain the variability of the thickness of the polishing layer, the surface of the polishing layer (zone) adjusted to a given thickness may be buffing treated. The buffing treatment is preferably conducted stepwise by using abrasive sheets having different particle size.

In the polishing layer formed from the foamed polyurethane of the present invention, it is required to provide grooves on the polishing surface (polishing zone) contact with a material to be polished to polish the material. The abrasive slurry provided during polishing the semi-conductor device is effectively retained by the presence of the grooves. The grooves also have a function of uniformly distributing the abrasive slurry on the polishing surface. In addition, the grooves also have a function of a path for briefly retaining abrasive waste, such as abrasive dust, used abrasive slurry, and smoothly discharging it to the exterior thereof. The grooves also prevent the material to be polished from breaking by the absorption of the material to be polished to the polishing layer.

Figure 1:
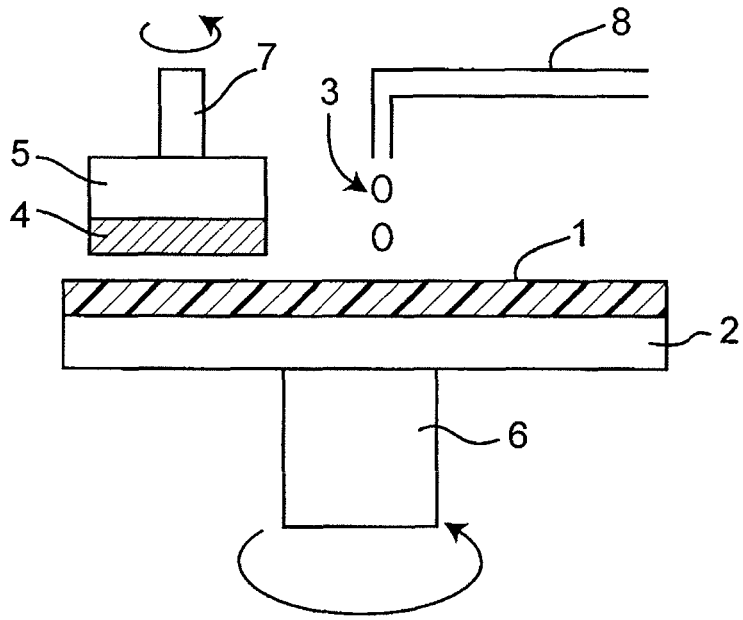
FIG. 1 is a schematic cross section illustrating a polishing apparatus generally used for CMP process.
Figure 2:
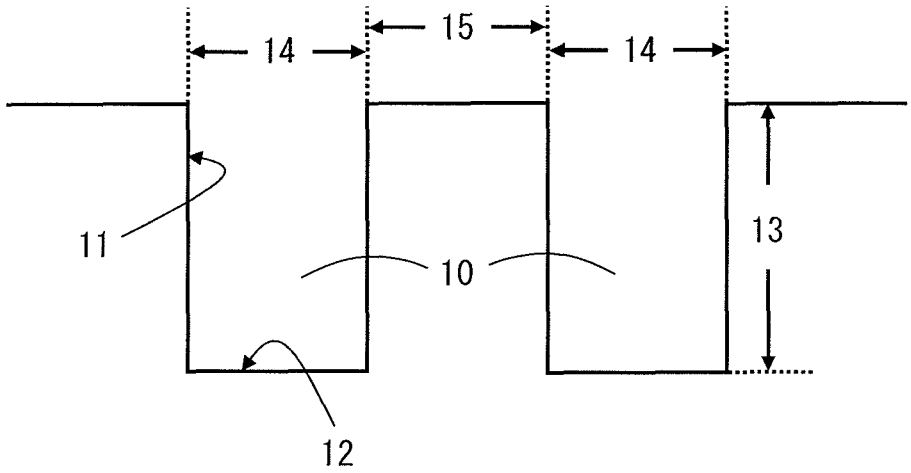
FIG. 2 is a schematic cross section illustrating groove having rectangular cross section shape.

The grooves on the surface of the polishing layer, of which the cross section shape is not particularly limited, includes, for example, rectangular groove comprising side surfaces and bottom surface, U-shaped groove, V-shaped groove and the like. FIG. 2 is a schematic cross section illustrating grooves having rectangular cross section shape. The side surface 11 and bottom surface 12 of the groove 10 shown in FIG. 2 are inner surface of the groove. The term "inner surface of groove" used herein refers to at least one surface of side surface and bottom surface of the groove. In case of U-shaped groove, it is difficult to distinguish between the side surface and bottom surface as the inner surface of the groove. In case of V-shaped groove, the inner surface of the groove comprises only the side surface.

In the polishing pad of the present invention, it is not necessary for the whole inner surface of the groove to be non-porous surface. In case of the groove having small depth and rectangular cross section shape, even if only the bottom surface of the groove is non-porous surface, it is considered that the technical effects accomplished by the present invention are sufficiently obtained. However, it is more preferable that the inner surface of the groove, which is at least one surface of the side surface and bottom surface of the groove, is a non-porous surface in whole, because more excellent technical effects can be obtained.

The shape of the groove on the polishing surface of the polishing layer is not particularly limited, but includes, for example, round loop, polygonal loop (such as triangle loop, square loop, pentagon loop), oval loop, and the like. The number of the groove is not particularly limited as long as it is not less than 2. The arrangement of the grooves is not particularly limited, but includes, for example, loop grooves concentrically arranged, loop grooves eccentrically arranged, loop grooves comprising one loop groove and the other grooves positioned in a portion surrounded by the loop groove on the polishing surface and the like.

Among the loop grooves described above, loop grooves arranged in the form of concentric circles are preferable in view of abrasive performance and easiness of processing the groove.

There may be grooves having the other shape or recesses on the polishing surface in addition to the loop grooves. The grooves having the other shape may be, for example, linear grooves arranged in the direction of the diameter on the polishing layer. The linear grooves may be arranged in a lattice pattern. There may be perforations penetrated from the polishing surface to the backside of the polishing layer in addition to the grooves described above.

It is desired for the groove on the surface of the polishing layer to have a width of 0.05 to 2.0 mm, preferably 0.20 to 0.50 mm. When the width of the groove is smaller than 0.05 mm, it is difficult to enter the abrasive slurry in the groove, and the technical effects of functioning as a flow path of the abrasive slurry are sufficiently obtained, which degrades the abrasive rate. In addition, it is very difficult to process the grooves having a width of smaller than 0.05 mm, and productivity is degraded. On the other hand, when the width of the groove is larger than 2.0 mm, the polishing effective area of the polishing surface of the polishing layer contact with the material to be polished is reduced, and the abrasive rate is reduced. The abrasive rate is a parameter used for evaluating the abrasive properties.

In the present invention, it is desired for the groove to have a pitch of 0.1 to 20 mm. The pitch 15 is distance between the groove 14 formed and the other groove 14 as shown in FIG. 2. When the pitch of the groove is smaller than 0.1 mm, many grooves are formed on the polishing pad, and the polishing effective area of the polishing surface of the polishing layer contact with a semiconductor wafer as the material to be polished is reduced, which reduces the abrasive rate. On the other hand, when the pitch of the groove is larger than 20 mm, the area of the polishing surface of the polishing layer contact with the material to be polished is increased, and the frictional resistance between the material to be polished and the polishing pad. Therefore, the material to be polished removes from the polishing head (which is so-called "dechucking"). The pitch of the groove means a shortest distance between adjacent grooves.

It is desired for the groove to have a depth of not less than 0.5 mm, which is a distance from the polishing surface to the deepest portion of the bottom surface. When the depth of the groove is less than 0.5 mm, the balance between feeding and discharging the abrasive slurry is not sufficiently obtained, which is not preferable for polishing. The depth of the groove is preferably not more than 0.85 of the thickness of the polishing layer having the polishing surface in view of the strength of the polishing pad. FIG. 2 is also a schematic cross section for illustrating the width 14, pitch 15 and depth 13 of the groove 10.

A method of forming the groove is not limited, but includes a method of mechanical cutting using, for example, a cutting tool of a predetermined size, a method of casting resin in a mold having a given surface shape and curing it, a method of pressing resin using a press plate having a given surface shape, a method of forming the grooves by photolithography, a method of forming the grooves by printing, a method of forming the grooves by laser light using carbon dioxide laser and the like. Preferred is the method of mechanical cutting.

The polishing pad formed from a porous material, such as foamed polyurethane is excellent to polishing the semi-conductor device. In case of forming the grooves on the porous material by the mechanical cutting, "burr" or open pore is formed by cutting the pore portion are formed on the inner surface, such as the side surface and bottom surface, of the groove. The used abrasive slurry and abrasive dust are easily remained and accumulated by the presence of the hangnail or open pore on the inner surface of the groove. Thereby the groove is stopped up, and the abrasive rate is reduced, a scratch occurs and the uniformity of polishing is not sufficiently obtained. Such polishing pad is not durable to long time polishing.

In order to solve the problems described above, it is considered to use methods of forming the groove, for example, by heat pressing, embossing, laser processing. The inner surface of the groove formed by the methods is smooth surface without burr, but the inner surface has a drawback to easily cause heat deterioration. The heat deterioration causes swelling of the groove, thermal hardening of the surface and the like, which cause scratches. On the other hand, in case of forming the polishing layer by non-foamed material, the groove having smooth inner surface can be also formed by cutting and the like. However, the polishing layer formed from the non-foamed material tends to have poor retainability of the abrasive slurry. In addition, since the non-foamed material has no pore formed by foaming, the abrasive slurry and abrasive dust have no escape, which increases the formation of scratches.

The polishing pad of the present invention comprises the polishing layer formed from a porous material and the inner surface of the groove formed on the surface of the polishing layer has a non-porous surface. The wording "the inner surface of the groove formed on the surface of the polishing layer has a non-porous surface" means that the polishing layer is formed from a porous material, but the inner surface of the groove formed on the polishing layer has smooth surface, which does not have any pores. In case that the inner surface of the groove has a non-porous surface, it is desired for the non-porous surface to have a center line average roughness Ra of a roughness curve of 1.0 to 5.0 μm, preferably 1.5 to 3.0 μm as a surface roughness. When the center line average roughness Ra of a roughness curve is larger than 5.0 μm, the technical effects of reducing of the unusual retainment of the abrasive slurry are not sufficiently obtained. On the other hand, it is difficult to prepare the non-porous surface having a center line average roughness Ra of a roughness curve of less than 1.0 μm based on the present technical level.

In the polishing pad of the present invention, since the polishing surface has grooves and the inner surface of the groove has the non-porous surface, it is possible to effectively restrain the clogging of the groove from the residual abrasive slurry and the retainment of the abrasive dust even if the polishing layer is formed from porous material. Therefore, it is possible to restrain the unusual retainment of the abrasive slurry, and it is possible to prepare the polishing pad having excellent long-term usability.

"A center line average roughness Ra of a roughness curve" used herein is a parameter according to JIS B 0601. The center line average roughness Ra of a roughness curve can be measured with an optical type surface roughness tester, such as a three-dimensional surface profiler, laser scanning microscope, electron beam surface profiler; a contact type surface roughness tester, such as a surface roughness tester with contact stylus; and the like.

A method of making the inner surface of the groove on the polishing layer a non-porous surface includes a method of forming the groove by cutting and the like, and then processing the inner surface of the groove to the non-porous surface by post processing. Examples of methods of post processing include a method of irradiating a laser beam to the surface portion of the inner surface of the groove by a laser processing machine to melt it; a method of thinly applying a resin to the surface portion of the inner surface of the groove to level it; a method of applying a resin to the groove portion, and then newly forming a groove; and the like.

Examples of the resins used for the post processing include resins that can be used for preparing the polishing layer. The inner surface of the groove can be treated to form the non-porous surface by applying the resin to the groove portion without the foaming treatment described above. Examples of methods of applying the resin to the groove portion include a method of coating the resin thermally melted thereto; a method of preparing a resin solution by dissolving or dispersing the resin in a solvent, and then coating or spraying the resin solution thereto; a method of applying polymerizable resin to the groove portion by coating or spraying, and then post curing it; and the like.

The polishing layer of the polishing pad of the present invention is formed from the porous material. Therefore, in the polishing effective area portion, which is the polishing surface other than the groove portion, that is, the groove pitch portion of the polishing layer, the porous surface is exposed. That is, the polishing surface has micro pores.

The polishing pad of the present invention may be a single-layered polishing pad, which is composed of only a polishing layer, or a laminated polishing pad comprising at least two layers of the polishing layer and a cushion layer positioned between the polishing layer and a polishing platen.

The polishing pad is preferably the laminated polishing pad comprising the polishing layer and the cushion layer. The cushion layer plays a role in compensating the properties of the polishing layer. The cushion layer is required in order to accomplish both the planarity and uniformity within wafer, which are relation of a trade-off in the CMP. The planarity means smoothness in a pattern portion when a material to be polished having micro unevenness formed during forming the pattern is polished, the uniformity within wafer means uniformity in the whole material to be polished. The planarity is improves by the properties of the polishing layer, the uniformity within wafer is improves by the properties of the cushion layer.

The hardness of the cushion layer is preferably lower than that of the polishing layer, which improves the adaptability of the polishing layer to the whole wafer, and the uniformity of the polishing layer is improved. It is desired for the cushion layer to have an Asker A hardness of 20 to 40, preferably 25 to 35.

Examples of materials for forming the cushion layer, which are not limited, but include a nonwoven fibrous fabric, such as polyester nonwoven fabric, nylon nonwoven fabric, acrylic nonwoven fabric; a resin impregnated nonwoven fabric, such as polyester nonwoven fabric impregnated with polyurethane; polymer resin foam, such as polyurethane foam, polyethylene foam; rubbery resin, such as butadiene rubber, isoprene rubber; photosensitive resin; and the like.

A method of laminating the polishing layer to the cushion layer include, for example, a method of interposing a double-coated tape between the polishing layer and the cushion, and then pressing it.

The double-coated tape comprises adhesive layers on the both surface of a substrate, such as nonwoven fabric and film. It is desired to use the film as a substrate in order to prevent the abrasive slurry from penetrating into the cushion layer. In addition, examples of the compositions for the adhesive layer include rubber-based adhesive, acrylic-based adhesive and the like. In view of the metal ion content, preferred is the acrylic-based adhesive, because it has small content of the metal ion. Since the composition of the polishing layer may be different from that of the cushion layer, each adhesive layer of the double-coated tape can have different composition and adjust the adhesion of the each adhesive layer to suitable range.

The polishing pad obtained as described above is mounted on the polishing platen by bonding with a double-coated tape, and the surface of semi-conductor wafer can be polished. The double-coated tape comprises adhesive layers on the both surface of a substrate, such as nonwoven fabric and film as described in the double-coated tape for bonding the polishing layer to the cushion layer. Since the polishing pad is removed from the platen after polishing, it is desired to use the film for the substrate, because it is possible to prevent the tape from remaining on the polishing platen. The same compositions for the adhesive layer as that of the double-coated tape for bonding the polishing layer to the cushion layer can be used.

Semi-conductor device is produced through the step of polishing the surface of semi-conductor wafer by using the polishing pad of the present invention. The semi-conductor wafer is generally formed by depositing wire metal and oxide film on silicon wafer. A method of polishing the semi-conductor wafer and polishing apparatus used for the method are not limited, but the method is conducted by using the polishing apparatus comprising, for example, a polishing platen for supporting a polishing pad, a supporting stand (polishing head) for supporting a material to be polished (such as a semi-conductor wafer), a backing for uniformly applying pressure to the wafer and an abrasive slurry-feeding mechanism. The polishing pad is mounted on the polishing platen by bonding with a double-coated tape. The polishing platen and supporting stand are positioned such that the polishing pad and semi-conductor wafer supported by the platen and the stand respectively are opposed to each other, and have an axis of revolution respectively. At the side of the supporting stand, a pressing mechanism for pushing the semi-conductor wafer onto the polishing pad is provided. During polishing, the semi-conductor wafer is pushed onto the polishing pad while rotating the polishing platen and supporting stand, and the polishing is conducted while feeding the abrasive slurry. Feed of the abrasive slurry, polishing load, revolution number of the polishing platen and revolution number of the semi-conductor wafer, which are not limited, are adjusted to suitable range.

Thereby, a projective portion on the surface of the material to be polished, such as the semi-conductor wafer, is smoothly polished. After the polishing, dicing, bonding, packaging and the like are conducted, and semi-conductor device is produced. The semi-conductor device is used for processor, memory and the like.

EXAMPLES

Hereinafter, the present invention is described in more detail by reference to the Examples, but the present invention is not limited by the Examples.

(Average Cell Diameter)

In measurement of average cell diameter, the material, such as the polishing layer was cut into a thickness of about 1 mm parallel to the layer with a microtome cutter as a sample for measuring the average cell diameter. The sample was mounted on a slide glass, and the diameter of the all cells was measured at an optional 0.2 mm×0.2 mm square area by using an image processing unit (Image Analyzer V10 manufactured by TOYOBO Co., Ltd.) to calculate the average cell diameter.

(Specific Gravity)

The specific gravity was measured according to JIS Z8807-1976. The material, such as the polishing layer was cut into a strip sized of 4 cm×8.5 cm (a proper thickness) as a sample for measuring the specific gravity, and the sample was left at a temperature of 23° C.±2° C. and humidity of 50%±5% for 16 hours. The specific gravity was measured by using a hydrometer (Sartorius K.K.).

(Hardness)

(1) Hardness of Polishing Layer

The hardness was measured according to JIS K6253-1997. The material for the polishing layer was cut into a size of 2 cm×2 cm (a' proper thickness) as a sample for measuring the hardness, and the sample was left at a temperature of 23° C.±2° C. and humidity of 50%±5% for 16 hours. The hardness was measured by using a stack of the samples having a thickness of not less than 6 mm with a hardness meter (Asker D hardness meter manufactured by Kobunshi Keiki Co., Ltd.).

(2) Hardness of Cushion Layer

The hardness was measured according to JIS K6253-1997. The material for the cushion layer was cut into a size of 2 cm×2 cm (a proper thickness) as a sample for measuring the hardness, and the sample was left at a temperature of 23° C.±2° C. and humidity of 50%±5% for 16 hours. The hardness was measured by using a stack of the samples having a thickness of not less than 6 mm with a hardness meter (Asker A hardness meter manufactured by Kobunshi Keiki Co., Ltd.).

(Compressibility)

The material for the polishing layer, which cut into disk having a diameter of 7 mm (a proper thickness), was used as a sample for measuring the compressibility, the sample was left at a temperature of 23° C.±2° C. and humidity of 60%±10% for 40 hours. The compressibility was measured by using TMA (SS6000; manufactured by Seiko Instruments). The compressibility is determined by using the following formula:

$$\text{Compressibility (\%)}=[(T_1-T_2)/T_1]\times 100$$

wherein $T_1$ represents the thickness of a sample after application of 30 kPa (300 g/cm$^2$) stress for 60 seconds to the sample, and $T_2$ represents the thickness of the sample after application of 180 kPa stress for 60 seconds to the sample in the state $T_1$.

(Compression Recovery)

The material for the polishing layer, which cut into disk having a diameter of 7 mm (a proper thickness), was used as a sample for measuring the compression recovery, the sample was left at a temperature of 23° C.±2° C. and humidity of 60%±10% for 40 hours. The compressibility was measured by using TMA (SS6000; manufactured by Seiko Instruments). The compressibility is determined by using the following formula:

$$\text{Compression recovery (\%)}=(T_3-T_2)/(T_1-T_2)\times 100$$

wherein $T_1$ represents the thickness of a sample after application of 30 kPa (300 g/cm$^2$) stress for 60 seconds to the sample, $T_2$ represents the thickness of the sample after application of 180 kPa stress for 60 seconds to the sample in the state $T_1$, and $T_3$ represents the thickness of the sample after no loaded state for 60 seconds and then application of 30 kPa (300 g/cm$^2$) stress for 60 seconds to the sample in the state $T_2$.

(Storage Elastic Modulus)

A 3 mm×40 mm rectangular sample (a proper thickness) was cut out and used as a sample for measurement of dynamic viscoelasticity. The accurate width and thickness of each sheet after cutting were measured using a micro-meter. For measurement, a dynamic viscoelasticity spectrometer (manufactured by Iwamoto Seisakusho, now IS Giken) was used to determine storage elastic modulus E'. Measurement conditions are as follows:

measurement temperature, 40° C.;

applied strain, 0.03%;

initial loading, 20 g; and frequency, 1 Hz.

[Evaluation of Abrasive Properties]

As the polishing apparatus, SPP600S manufactured by Okamoto Machine Tool Works, Ltd. was used in evaluation of abrasive properties of the resulting polishing pad.

(Abrasive Rate)

The abrasive rate was determined by the calculation from a time until polishing 0.5 μm thickness of an oxide film from the oxide film formed on silicon wafer having a diameter of 8 inches. The thickness of an oxide film was measured by an interference film thickness measuring device manufactured by Otsuka Denshisha. The polishing conditions were as follows: silica slurry SemiSperse-12 (manufactured by Cabot) was dropped at a flow rate of 150 mL/min., the polishing loading was 350 g/cm$^2$, the number of revolutions of the polishing platen was 35 rpm, and the number of revolutions of the wafer was 30 rpm.

(Planarity)

For evaluation of planarity, a 0.5 μm thermal-oxide film was deposited on a 8-inch silicon wafer and subjected to patterning, and a 1 μm oxide film p-TEOS (tetraethoxy silane) was further deposited thereon, to prepare a wafer having a pattern with an initial difference in level of 0.5 μm. This wafer was polished under the above-described conditions, and each difference in level was measured to evaluate the planarity. The planarity was determined by measuring the two differences in level. One is a local difference in level, which is level difference in the pattern where lines having a width of 270 μm were spaced at 30 μm, that is, the difference in level after 1 minute from polishing. The other is the abrasive amount in 270 μm space when the global difference in level between tops of lines in two patterns, which are a pattern where lines having a width of 270 μm is spaced at 30 μm and a pattern where lines having a width of 30 μm is spaced at 270 μm, was reduced to 2000 Å or less was measured to evaluate the planarity. The smaller the local difference in level, the higher the speed of planarizing unevenness of the oxide film formed depending to the pattern on the wafer within a certain time. The smaller the abrasive amount in the space, the smaller the abrasive amount of the portion not to be polished, and it is shown that the planarity is excellent.

(Uniformity within Wafer)

After polishing, the thickness of the film was measured at 25 points on the polished surface of a silicon wafer. The maximum thickness Tmax and minimum thickness Tmin of the film were used to calculate uniformity (%) according to the following equation:

$$\text{Uniformity Within Wafer (\%)}=(T\max-T\min)/(T\max+T\min)\cdot\times 100$$

The smaller the value of the uniformity is, the higher the uniformity within the surface of the silicon wafer is.

(Number of Scratch)

Number of scratches of not less than 0.5 μm on the wafer after polishing was measured with a wafer surface analyzer WM2500 manufactured by Topcon Corporation (Surface Roughness Ra)

The inner surface portion of the groove formed on the polishing surface of the polishing layer was cut out as a test piece. The test piece adhered on the glass platen with a wax. The center line average roughness Ra of a roughness curve of the test piece on the glass platen was measured as surface roughness according to JIS B 0633 with a surface profiler P-15 manufactured by Tencor Corporation at the following measuring condition.

Scan length: 2500 μm

Scan speed: 20 μm/sec

Stylus force: 2 mg

Stylus radius: 2.0 μm

Cone angle of stylus tip: 60 degree

Further 4 test pieces were prepared as described above, and the center line average roughness Ra was measured as described above. The average of the resulting 5 measured values was determined, and the average is shown as the center line average roughness Ra of a roughness curve as the surface roughness Ra.

(Sectional Shape of Groove)

The sectional shape of the groove was evaluated by using the following evaluation criteria.

Evaluation Criteria

○: An average of the groove width measured at three points in the depth direction when observing the sectional shape of the groove is within the target range and the deviation of the three measuring points is not more than 30 μm or not more than 10% of the target range. Therefore, rectangle sectional shape is obtained.

Δ: The average of the groove width is within the target range, but the deviation is larger than 30 μm. Burrs is largely formed only at one portion. The rectangle sectional shape is generally obtained and the deviation of the three measuring points is not more than 30 μm, but the average of the groove width is slightly out of the target range.

x: The average of the groove width is out of the target range and rectangle sectional shape is not entirely obtained.

(Surface Burr)

Burr from the groove to the surface in the sectional surface, in which the sectional shape of the groove was measured, was evaluated by using the following evaluation criteria.

Evaluation Criteria

○: Not more than 80 μm

Δ: From 80 to 100 μm x: Not less than 100 μm (Wear of Groove Processing Tool)

Figure 7:
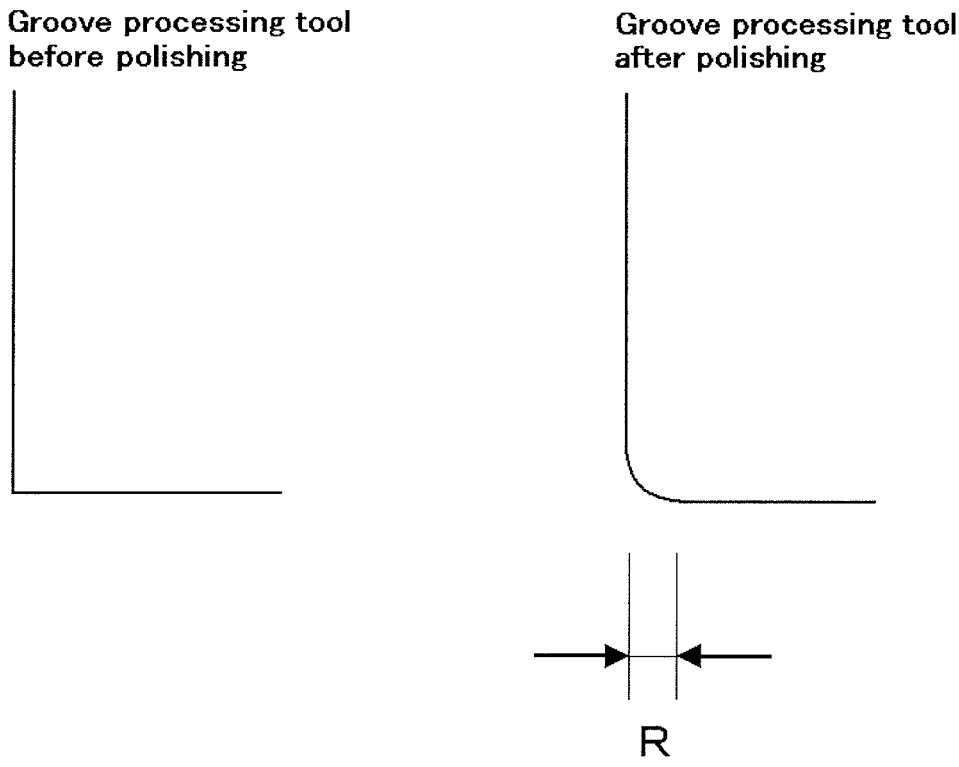
FIG. 7 is an enlarged schematic diagram of the corner portion of the cutting edge of the groove processing tool before and after polishing illustrating the test method of the wear of the groove processing tool.

After processing the groove by using the groove processing tool, of which the cutting edge was newly polished, the wear state of the cutting edge of the groove processing tool was evaluated. The R of the corner portion of the cutting edge shown in FIG. 7 was measured (by using a scanning electron microscopy SEM or microscope), and the wear of the groove processing tool was evaluated by using the following evaluation criteria.

Evaluation Criteria

○: R=0 to 0.20 mm and the corner portion of the cutting edge is not nicked.

Δ: R=0.20 to 0.30 mm and the corner portion of the cutting edge is slightly nicked.

x: R=not less than 0.30 mm and the corner portion of the cutting edge is largely nicked.

Example 1

Preparation of Polishing Layer 100 parts by weight of a polyether-based urethane prepolymer (Adiprene L-325 manufactured by Uniroyal, NCO content: 2.22 meq/g) filtered and 3 parts by weight of a silicone-based nonionic surfactant (SH192 manufactured by Toray Dow Corning Silicone Co., Ltd.) were introduced into a fluorine coated vessel and mixed, and the temperature was maintained to 80° C. The mixture was vigorously stirred for about 4 minutes at about 900 rpm by using a fluorine coated stirrer with introducing air into reaction process. 26 parts by weight of 4,4'-methylene-bis(o-chloroaniline) (Ihara Cuamine MT manufactured by Ihara Chemical Industry) previously melted at 120° C. and filtered was introduced thereto. After stirring for about 1 minute, the mixed reaction solution was introduced into a fluorine coated pan-type open mold. When the reaction solution did not flow, the mold was put in an oven and post-cured at 110° C. for 6 hours to produce a foamed polyurethane resin block. This foamed polyurethane resin block was sliced by a slicer of band saw type (manufactured by Fecken) to obtain a foamed polyurethane resin sheet.

The sheet was buffing treated with a buff (manufactured by Amitec) to form a sheet having the desired thickness (sheet thickness: 1.27 mm). The buffing treated sheet for the polishing layer had an average cell diameter of 45 μm, a specific gravity of 0.86, a hardness of 53, a compressibility of 1.0%, a compression recovery of 65.0% and a flexural modulus of 275 MPa. The buffing treated sheet was punched into a disk having a diameter of 24 inches (610 mm), and concentric circular grooves having a depth of 0.8 mm, width of 0.25 mm and pitch of 1.5 mm were formed on the surface of the sheet by using a surface groove processing machine (Toho Engineering).

The resin used for the foamed polyurethane resin sheet was prepared as described above without stirring with introducing air into reaction process, and then the resin was vacuum defoamed to prepare a resin used for post processing. The resulting resin was coated on the groove portion in the uncured state, and cured by heat treatment. The cured resin portion was then cut as described above to form grooves again (post processing). The cutting was attentively conducted without cutting all the coated resin. As a result, the polishing layer, of which both the side surface and bottom surface as the inner surface of the groove were non-porous surface, was prepared.

The inner surface of the groove before post processing had a center line average roughness Ra of a roughness curve of 7 to 20 μm, and the inner surface of the groove after post processing had a center line average roughness Ra of a roughness curve of 0.6 to 1.0 μm.

A double-coated tape (double-tack tape manufactured by Sekisui Chemical Co., Ltd.) adhered to the opposite side of the groove processed surface of the polishing layer sheet by using a laminator.

Production of Polishing Pad

A polyethylene foam (Toray PEF manufactured by Toray Industries, Inc.) (thickness, 0.8 mm) having a surface brushed with a buff and subjected to corona treatment as a cushion layer was laminated to the adhesive surface of the double-coated tape on the polishing layer by using a laminator. In addition, a double-coated tape adhered to the opposite side of the cushion layer by using a laminator to prepare a polishing pad.

The abrasive properties of the resulting polishing pad were measured or evaluated. As a result, a silicon wafer polished by using the polishing pad had a few scratches and good uniformity, and the polishing pad had good stability of polishing the silicon wafer for a long time of not less than 40 hours such that abrasive dust and abrasive slurry were not unusually remained in the grooves.

Comparative Example 1

100 parts by weight of a polyether-based urethane prepolymer (Adiprene L-325 manufactured by Uniroyal, NCO content: 2.22 meq/g) filtered and 3 parts by weight of a silicone-based nonionic surfactant (SH192 manufactured by Toray Dow Corning Silicone Co., Ltd.) were introduced into a fluorine coated vessel and mixed, and the temperature was maintained to 80° C. The mixture was vigorously stirred for about 4 minutes at about 900 rpm by using a fluorine coated stirrer with introducing air into reaction process. 26 parts by weight of 4,4'-methylene-bis(o-chloroaniline) (Ihara Cuamine MT manufactured by Ihara Chemical Industry) previously melted at 120° C. and filtered was introduced thereto. After stirring for about 1 minute, the mixed reaction solution was introduced into a fluorine coated pan-type open mold. When the reaction solution did not flow, the mold was put in an oven and post-cured at 110° C. for 6 hours to produce a foamed polyurethane resin block. This foamed polyurethane resin block was sliced by a slicer of band saw type (manufactured by Fecken) to obtain a foamed polyurethane resin sheet.

The sheet was buffing treated with a buff (manufactured by Amitec) to form a sheet having the desired thickness (sheet thickness: 1.27 mm). The buffing treated sheet for the polishing layer had an average cell diameter of 45 μm, a specific gravity of 0.86, a hardness of 53, a compressibility of 1.0%, a compression recovery of 65.0% and a flexural modulus of 275 MPa. The buffing treated sheet was punched into a disk having a diameter of 24 inches (610 mm), and concentric circular grooves having a depth of 0.8 mm, width of 0.25 mm and pitch of 1.5 mm were formed on the surface of the sheet by using a surface groove processing machine (Toho Engineering) to prepare the polishing layer sheet having groove processed polishing surface.

The inner surface of the groove (without post processing) had a center line average roughness Ra of a roughness curve of 7 to 20 μm.

A double-coated tape (double-tack tape manufactured by Sekisui Chemical Co., Ltd.) adhered to the opposite side of the groove processed surface of the polishing layer sheet by using a laminator.

Production of Polishing Pad

A polyethylene foam (Toray PEF manufactured by Toray Industries, Inc.) (thickness, 0.8 mm) having a surface brushed with a buff and subjected to corona treatment as a cushion layer was laminated to the adhesive surface of the double-coated tape on the polishing layer by using a laminator. In addition, a double-coated tape adhered to the opposite side of the cushion layer by using a laminator to prepare a polishing pad.

The abrasive properties of the resulting polishing pad were measured or evaluated. As a result, a silicon wafer polished by using the polishing pad had scratches after polishing for 15 hours, and the abrasive dust and abrasive slurry were unusually remained in the grooves.

Example 2

100 parts by weight of a polyether-based urethane prepolymer (Adiprene L-325 manufactured by Uniroyal, NCO content: 2.22 meq/g) filtered and 3 parts by weight of a silicone-based nonionic surfactant (SH192 manufactured by Toray Dow Corning Silicone Co., Ltd.) were introduced into a fluorine coated vessel and mixed, and the temperature was maintained to 80° C. The mixture was vigorously stirred for about 4 minutes at about 900 rpm by using a fluorine coated stirrer with introducing air into reaction process. 26 parts by weight of 4,4'-methylene-bis(o-chloroaniline) (Ihara Cuamine MT manufactured by Ihara Chemical Industry) previously melted at 120° C. and filtered was introduced thereto. After stirring for about 1 minute, the mixed reaction solution was introduced into a fluorine coated pan-type open mold. When the reaction solution did not flow, the mold was put in an oven and post-cured at 110° C. for 6 hours to produce a foamed polyurethane resin block. This foamed polyurethane resin block was sliced by a slicer of band saw type (manufactured by Fecken) to obtain a foamed polyurethane resin sheet. The sheet was buffing treated with a buff (manufactured by Amitec) to form a sheet having the desired thickness (sheet thickness: 1.27 mm). The buffing treated sheet for the polishing layer had an average cell diameter of 45 μm, a specific gravity of 0.86, a hardness of 53, a compressibility of 1.0%, a compression recovery of 65.0% and a flexural modulus of 275 MPa.

The buffing treated sheet was punched into a disk having a diameter of 24 inches (610 mm), and concentric circular grooves having a width of 0.25 mm, depth of 0.40 mm and pitch of 1.5 mm were formed on the surface of the polishing layer sheet by using a surface groove processing machine. A feed speed of a groove processing tool was No. 1 shown in the following Table 2. The surface roughness of the resulting groove processing surface was measured, and the shape of the groove, surface burr and wear of the groove processing tool were evaluated. The results are shown in the following Table 1 and Table 2. A double-coated tape (double-tack tape manufactured by Sekisui Chemical Co., Ltd.) adhered to the opposite side of the groove processed surface of the polishing layer sheet by using a laminator. A cushion sheet (polyethylene foam, Toray PEF manufactured by Toray Industries, Inc., thickness: 0.8 mm) having a surface brushed with a buff and subjected to corona treatment was laminated to the adhesive surface of the double-coated tape on the polishing layer by using a laminator. In addition, a double-coated tape adhered to the opposite side of the cushion layer by using a laminator to prepare a polishing pad.

Example 3

The polishing pad was prepared as described in Example 2 except that the feed speed of a groove processing tool was No. 4 shown in the following Table 2. The surface roughness of the resulting groove processing surface was measured, and the shape of the groove, surface burr and wear of the groove processing tool were evaluated. The results are shown in the following Table 1 and Table 2.

Comparative Example 2

The polishing pad was prepared as described in Example 2 except that the feed speed of a groove processing tool was No.

11 shown in the following Table 2. The surface roughness of the resulting groove processing surface was measured, and the shape of the groove, surface burr and wear of the groove processing tool were evaluated. The results are shown in the following Table 1 and Table 2.

The abrasive properties of the polishing pads of Examples 2 to 3 and Comparative Example 2 were evaluated. The results are shown in the following Table 1.

TABLE 1

| | Example No. | | Comparative Example No. |
|---|---|---|---|
| | 1 | 2 | 1 |
| Surface roughness Ra | 5.57 | 8.59 | 12.54 |
| Abrasive rate (Å/min) | 2300 | 2300 | 2350 |
| Number of scratches (per a wafer) | 53 | 76 | 178 |

TABLE 2

| | Feed speed of groove processing tool (m/min) | | | | $T_s$ | Groove | | |
|---|---|---|---|---|---|---|---|---|
| No. | 1 | 2 | 3 | 4 | (sec) | shape | Burr | W |
| 1 | 0.01 | 0.03 | 0.05 | 1.00 | 1.00 | Δ | ○ | Δ |
| 2 | 0.01 | 0.03 | 0.05 | 0.08 | — | ○ | ○ | ○ |
| 3 | 0.01 | 0.03 | 0.05 | — | — | ○ | ○ | ○ |
| 4 | 0.01 | 0.03 | — | — | — | ○ | ○ | ○ |
| 5 | 0.03 | 0.05 | 0.08 | 1.00 | — | ○ | Δ | ○ |
| 6 | 0.03 | 0.05 | 0.08 | — | — | ○ | Δ | ○ |
| 7 | 0.03 | 0.05 | — | — | — | ○ | Δ | ○ |
| 8 | 0.01 | — | — | — | — | ○ | ○ | x |
| 9 | 0.03 | — | — | — | — | Δ | Δ | ○ |
| 10 | 0.05 | — | — | — | — | x | x | ○ |
| 11 | 0.08 | — | — | — | — | x | x | ○ |
| 12 | 1.00 | — | — | — | — | x | x | ○ |
| 13 | 2.00 | — | — | — | — | x | x | Δ |

$T_s$: Stop time of groove processing tool
W: Wear of groove processing tool

As apparent from the results of Table 1, the polishing pads of Examples 2 to 3 had smaller surface roughness of the groove processing surface and smaller number of scratches than the polishing pad of Comparative Example 2. The polishing pads of Examples 2 to 3 had excellent abrasive properties as compared with the polishing pad of Comparative Example 2.

On the other hand, in the polishing pad of Comparative Example 2 produced without the method of producing the polishing pad of the present invention, the abrasive rate was not reduced, but the number of scratches was very large and the burr on the surface of the pad from groove processing was largely degraded.

As described above, the feed speed of a groove processing tool in the polishing pads of Examples 2 to 3 and Comparative Example 2 are No. 1, No. 4 and No. 11 shown in Table 2, respectively. The feed speed of the groove processing tool is stepwise varied in No. 1 and No. 4, stepwise increased in No. 4, and increased or decreased in No. 1. In No. 1, there is a time that the feed speed is zero at the position of reaching the groove processing tool to the desired groove depth.

On the other hand, No. 11 is a conventional method of producing the polishing pad that the feed speed of the groove processing tool is constant in the groove processing step. In the polishing pads of Examples 2 and 3, the grooves having precise rectangle sectional shape and a few surface burr on the groove processed surface are obtained by stepwise varying the feed speed of the groove processing tool as shown in No. 1 and No. 4. On the other hand, in the polishing pad of Comparative Example 2, since the feed speed is constant as shown in No. 11, the sectional shape of the groove is not precise rectangle and the groove has many surface burrs on the groove processed surface.

What is claimed is:

1. A method of producing a semiconductor wafer polishing pad, comprising:

providing a polishing layer sheet comprising a polishing surface; and mechanically cutting the polishing surface of the polishing sheet by a groove processing tool to form concentric circular grooves having rectangle sectional shape on the polishing surface, wherein a feed speed of the groove processing tool to make the grooves has a plurality of constant values and the feed speed is changed from one of the constant values to another of the constant values during forming of one of concentric circular grooves.

2. The method according to claim 1, wherein the cutting of the polishing surface comprises stopping feed of the groove processing tool for a certain time at the position where the groove processing tool reaches a desired depth.

3. The method according to claim 1, wherein the feed speed is changed in an ascending order of the constant values.

4. The method according to claim 1, wherein the polishing pad is formed from a foamed polyurethane.

* * * * *